US010646393B2

(12) United States Patent
McGee

(10) Patent No.: US 10,646,393 B2
(45) Date of Patent: May 12, 2020

(54) SHEET CLAMP

(71) Applicant: GBUK Limited, Selby, North Yorkshire (GB)

(72) Inventor: Dane McGee, Wetherby (GB)

(73) Assignee: GBUK Limited, Selby, North Yorkshire (GB)

( * ) Notice: Subject to any disclaimer, the term of this patent is extended or adjusted under 35 U.S.C. 154(b) by 66 days.

(21) Appl. No.: 15/954,870

(22) Filed: Apr. 17, 2018

(65) Prior Publication Data

US 2018/0296417 A1 Oct. 18, 2018

Related U.S. Application Data

(60) Provisional application No. 62/486,717, filed on Apr. 18, 2017.

(51) Int. Cl.

| | |
|---|---|
| ***A61G 7/10*** | (2006.01) |
| ***A44B 13/00*** | (2006.01) |
| *A44B 11/02* | (2006.01) |

(52) U.S. Cl.

CPC ..... *A61G 7/1078* (2013.01); *A44B 13/0076* (2013.01); *A61G 7/1023* (2013.01); *A61G 7/1026* (2013.01); *A44B 11/02* (2013.01)

(58) Field of Classification Search

CPC .. A61G 7/1078; A61G 7/1026; A61G 7/1023; A44B 13/0076; A44B 11/02

See application file for complete search history.

(56) References Cited

U.S. PATENT DOCUMENTS

| | | | | |
|---|---|---|---|---|
| 3,969,792 A * | 7/1976 | Hattori | A44B 11/02 | 24/200 |
| 4,117,573 A * | 10/1978 | Nakamura | A44B 11/02 | 24/200 |
| 4,392,277 A * | 7/1983 | Muller | A44B 11/02 | 24/196 |
| 4,400,855 A * | 8/1983 | Stuart | B65D 63/16 | 24/200 |
| 5,426,829 A * | 6/1995 | Hsiung | A44B 11/02 | 24/16 R |
| 6,412,150 B1 * | 7/2002 | Monderine | A44B 11/02 | 24/200 |
| 8,251,244 B2 * | 8/2012 | Henf | A62B 9/04 | 220/324 |

(Continued)

FOREIGN PATENT DOCUMENTS

| | | |
|---|---|---|
| GB | 192742 A | 2/1923 |
| GB | 2438367 A | 11/2007 |

OTHER PUBLICATIONS

Examnation Report under Section 18(3) for corresponding Great Britain application GB1521114.7.

(Continued)

*Primary Examiner* — Robert Sandy
*Assistant Examiner* — Louis A Mercado
(74) *Attorney, Agent, or Firm* — Harness, Dickey & Pierce, P.L.C.

(57) ABSTRACT

A clamp for engaging one or more sheets of fabric for moving or repositioning an immobile occupant of a bed or trolley, the clamp having a body with chamfered channel, a block configured to be received within the channel, and a returning member to selectively permit the block to be removed from the channel.

12 Claims, 6 Drawing Sheets

(56) References Cited

U.S. PATENT DOCUMENTS

| | | | | |
|---|---|---|---|---|
| 9,414,977 | B2 * | 8/2016 | Ponsi | A61G 7/001 |
| 2002/0083521 | A1 * | 7/2002 | Sverdlik | A61G 7/1015 5/81.1 R |
| 2002/0083522 | A1 * | 7/2002 | Sverdlik | A61G 7/1015 5/81.1 R |
| 2003/0071509 | A1 | 4/2003 | Neil et al. | |
| 2003/0098027 | A1 * | 5/2003 | Mori | A41F 9/002 128/876 |
| 2006/0005293 | A1 * | 1/2006 | Frey | A44B 11/006 2/44 |
| 2008/0222807 | A1 | 9/2008 | Hanes | |
| 2010/0122437 | A1 * | 5/2010 | Hortnagl | A44B 11/02 24/163 R |
| 2014/0082891 | A1 * | 3/2014 | Hetrick | A44B 11/2557 24/115 H |

OTHER PUBLICATIONS

Search Report from corresponding application GB1521114.7, dated May 31, 2016.

* cited by examiner

| | | |
|---|---|---|
| Wrap sheet/fabric over lozenge and tilt and insert into the chamfered hole in the clamp base |  | (a) |
| |  | (b) |
| Pull the sheet and lozenge so the chamfer of the lozenge engages with the chamfer of the clamp base-clamping the sheet in between the lozenge and the clamp base plate |  | (c) |
| Close the clamp - the lozenge cannot twist or come out |  | (d) |

| | | |
|---|---|---|
| Fit either a cord with cord end - note how the cord end is inserted in the hole at the end of the slot<br><br>then positioned in the recess in the middle of the slot to hold it central in the slot |  | (e) |
| Or - fit any type of strap, webbing or hook and loop e.t.c |  | (f) |

SHEET CLAMP

CROSS-REFERENCE TO RELATED APPLICATIONS

This application claims the benefit of U.S. Provisional Application No. 62/486,717 filed on Apr. 18, 2017. The entire disclosure of the above application is incorporated herein by reference.

FIELD

This invention relates to a clamp for engaging a sheet of fabric material to enable force to be applied to the sheet. The invention relates particularly, but not exclusively to a clamp for engaging one or more textile sheets, especially bedding sheets. The invention finds particular application for applying force to bedding sheets for moving or repositioning an immobile occupant of a bed or trolley. For example, in a hospital, clinic or other caring environments.

BACKGROUND

Current clamps and connectors for bed sheets or special repositioning fabrics rely upon friction created by a cam-operated clamp or by wrapping the sheet around a square or rectangular bar and then inserting the bar into a suitably designed profile. These methods can take more space than a human hand and are difficult to apply and remove. Because modern fabrics used for repositioning sheets can be impregnated with very low friction additives such as silicone, some clamps cannot safely hold these types of fabric with the amount of force required to allow repositioning of an occupant.

SUMMARY

According to the present invention a sheet clamp comprises:

a body having first and second sides and an aperture extending between the first and second sides to provide a channel through which a portion of one or more folded sheets may be inserted in use from the first side to the second side;

the channel having opposed side walls, a dimension of the channel between the side walls decreasing from the second side to the first side;

a clamping block having two block sides dimensioned to be received within the channel with the block sides engaging the side walls of the channel when inserted from the second side of the channel;

a retaining member pivotally mounted on the body and moveable between a first position in which the channel is open, permitting the block to be removed from the channel and a second position in which the retaining member covers the channel from the second side preventing removal of the block from the channel.

The block may take the form of a lozenge, having parallel upper and lower surfaces, parallel sides and rounded ends.

Preferably the height of the block has a maximum dimension less than the width of the channel, permitting the block with one or more sheets wrapped around the block to be inserted through the channel.

A dimension of the block may be sufficiently large that the block cannot pass through the first side of the channel when in the operative orientation.

In use an edge or other portion of a sheet may be wrapped around the block so that the block and sheet may be inserted through the channel after which the block may be rotated to an orientation in which the block sides are aligned with the side walls, following which the sheet may be pulled back towards the first side of the channel to secure the block and sheet within the channel.

In a preferred embodiment the side walls of the channel and the block sides taper uniformly from the second side to the first side. The side walls and block sides may have a V-shaped configuration in cross section.

Alternatively the side walls and sides may be concave and convex respectively, being configured to cooperate to securely engage a sheet located between them.

In a first embodiment the channel and blocks are elongate in plan view having a greater longitudinal dimension rather than transverse dimension.

In a second embodiment the channel and block may be rectangular or square in plan view.

Both channel and block may have rounded corners to reduce the risk of tearing of a sheet in use.

The sides of the block may have a similar or complimentary configuration to the side walls of the channel. Preferably the sides to define a gap of constant width, dimensioned to receive one or more layers of a sheet material without the block protruding from the first side of the body.

The body may include a second aperture extending between the first and second sides and dimensioned to receive fixture, for example a cord, cable, strap, webbing or hook and loop arrangement by which force may be applied to the clamp.

The aperture may comprise a slot and a larger bore dimensioned to permit a fastening head attached to a cable to pass through the aperture, after which the cable may be moved along the slot so that the head prevents removal of the cable from the slot.

The retaining member may have a similarly configured aperture arranged to be aligned with the aperture of the body in the second closed position.

Such an arrangement permits a cord, cable or strap to pass through the body and retaining member securing the retaining member in the second closed position when force is applied to a sheet in use.

Preferably the slot is parallel to the elongate dimension or sides of the channel so that force is applied uniformly across the width of a sheet located in the slot.

The side walls of the channel and sides of the block may extend at an angle of 5° to 80° to the channel axis. The angle may be selected in accordance with the thickness of the sheet material to be clamped. A larger angle may be preferred for a quilted sheet. An angle of 5° to 30°, preferably 9° to 11° may be employed for a conventional bedding sheet. Alternatively, an angle of 20° to 30° may be used for quilted sheet materials.

In a preferred embodiment the body and retaining member comprise laminar plates. The plates may have the same peripheral dimensions so that they overlie one another in the closed position to form a unitary assembly having smooth edges.

The clamping arrangement of the present invention confers numerous advantages. The clamp may be the size of an average human hand making it convenient to use, so that the force applied by the clamp is similar in use to the effect of a carer or nurse grapping and holding a sheet.

The clamp can be pulled by a cord or cable with a suitable end fitting or by a strap composed of webbing, a hook or loop or other readily available materials.

The clamp may be fitted to existing medical mattresses, for example with zip off covers, and overlays to enable attachment to bed frames.

The greater the force applied to the sheet the greater the engagement force between the chamfered edges of the body and block. By this means movement of a sheet within the clamp is prevented.

The clamp may be used with a wide range of sheets of different fabric or material types and thicknesses, ranging from very thin sheets to sheets having a thickness of 2 mm-3 mm.

The clamp may be manufactured from polypropylene to provide chemical resistance and overall durability, although a variety of other materials such as Acetal (POM), medium high or ultra high density polyolefin, nylon or UPVC (unplasticised polyvinylchloride) or PVC (polyvinylchloride).

When not in use the block can be stored within the channel and retained by the retaining member.

For multiple patient use the clamp may be disinfected by any convenient means.

The block is designed to be thinner, typically by about 3 mm than the depth of the clamp body so that even when clamping a thicker mattress cover fabric when the block is pulled down into the channel the fabric does not stand above the body and is therefore not damaged by movement of the retaining member into the closed position.

A second slot may be provided in the retaining member, located to overlie the channel so that a user may view the sheet when the retaining member is in the closed position. The slot may also allow the strap to be inserted through the slot and the channel so that the clamp may function as an adapter between two other clamps if required.

DRAWINGS

The invention is further described by means of example, but not in any limitative sense with reference to the accompanying drawings of which FIG. 1 is an exploded view of a clamp in accordance with the present invention;

DETAILED DESCRIPTION

Figure 1:
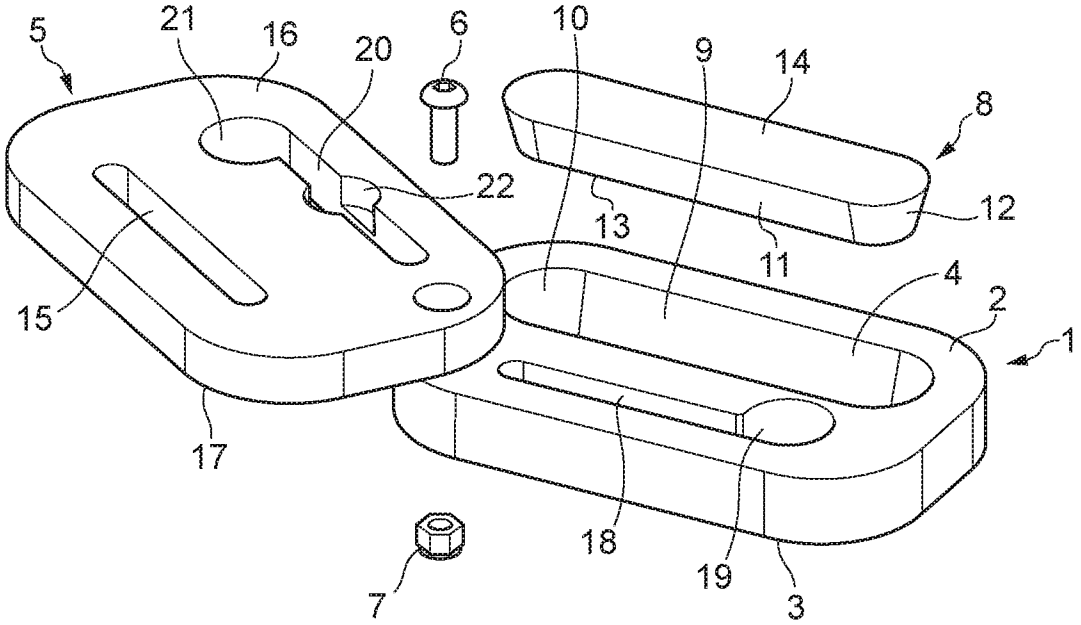
Figure 2:
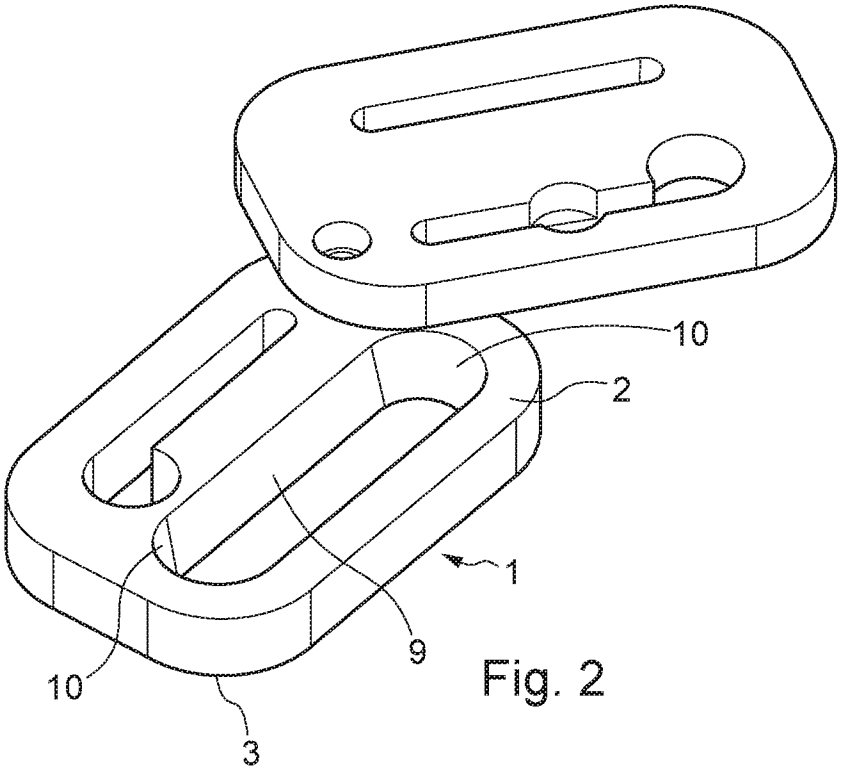
FIG. 2 is an assembled view of the body and retaining member in a first, open position.

FIGS. 1 and 2 show a first embodiment of the invention. A generally rectangular laminar body (1) has a planar upper surface (2) and a lower surface (3). An aperture extends between the upper (2) and lower (3) surfaces to form a channel (4) extending between the second side (2) and the first side (3) of the body. The channel (4) extends adjacent a long side of the body (1).

A plate-like retaining member (5) is pivotally secured by a bolt (6) and nut (7) to the body (1) adjacent a corner remote from the channel (4) so that the retaining member (5) may be rotated from a first position in which the channel (4) is exposed to a second position in which the retaining member (5) overlies the body (1) and closes the channel (4).

A clamping block (8) is configured to be completely received within the channel (4).

The channel (4) has opposed side walls (9) and rounded end walls (10). The side walls (9) and optionally the end walls (10) are inclined inwardly from the second side (2) to the first side (3). The transverse dimension between the side walls (9) decreases from the second (uppermost as shown) side (2) to the first (lowermost as shown) side (3) so that the sides taper inwardly from the top to the bottom at an angle between 9° to 11° to the vertical axis of the channel (4).

Clamp block (8) has sides (11) and ends (12) inclined at the same angle as the side walls (9, 10) so that the lozenge-shaped block (8) can fit into the channel (4) when inserted from the second upper side (2) but is prevented from passing through the channel (4) because the maximum transverse dimension of the block (8) is greater than the minimum transverse dimension of the channel (4).

The height of the block's (8) lower surface (13) to upper surface (14) is sufficiently less than the transverse width of the channel (4), so that the block (8) and the sheet wrapped around the block (8) may be inserted completely through the channel (4) when turned sideways and end on as described below.

A slot (15) extending between upper (16) and lower (17) sides of the retaining member (5) is aligned with the channel (4) in the closed position, allowing the block (8) and rounding sheet to be observed. This enables a user to determine that the sheet is correctly arranged within the clamp in use.

Slot (15) allows a strap to be passed through the slot (15) and channel (4), when the block (8) is removed, so that the clamp may function as adapter between two further clamps if required.

An aperture (18) and bore (19) extend between the first (3) and second (2) sides of the body (1). An aperture (20) and bore (21) extend through the retaining member (5) and are arranged to be aligned with the aperture (18) and bore (19) to form a continuous passageway through the entire clamp when in the closed position. Aperture (20) forms a slot parallel to the slot (15) having a width to receive a strap or webbing to enable the clamp to be fixed to a bed frame or other fixture in use. Bore (21) allows the head of a retaining cable to be inserted through the passageway after which the cable may be moved along the aperture (20) and the head engaged in a cylindrical rebate (22) in order to prevent unwanted disengagement during use.

Figure 3:
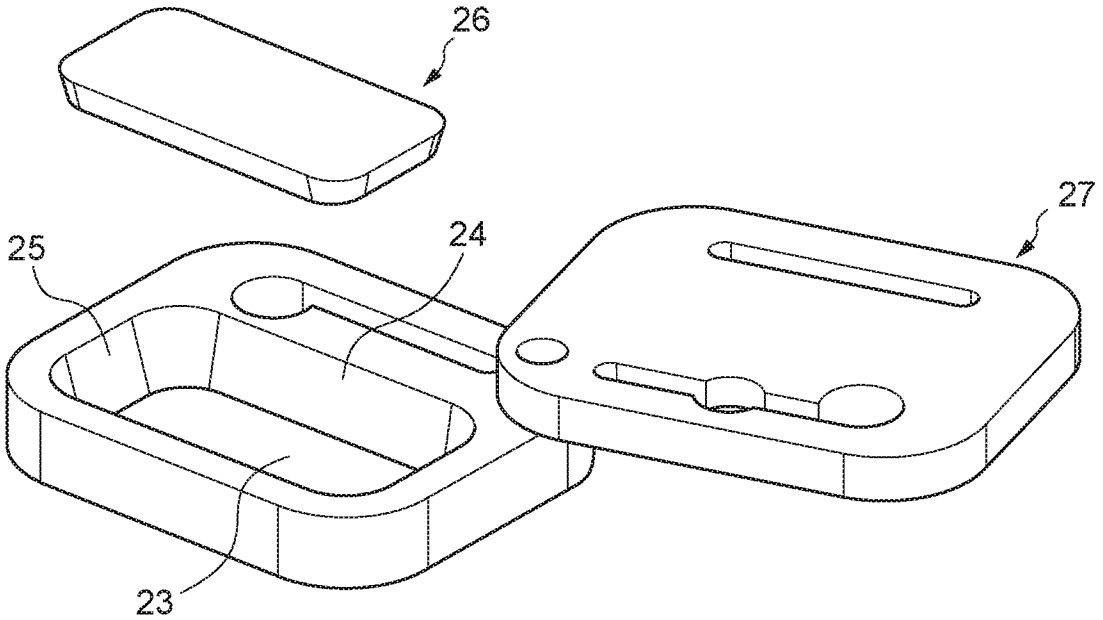
FIG. 3 is an alternative embodiment in which the channel is rectangular.
Figure 4:
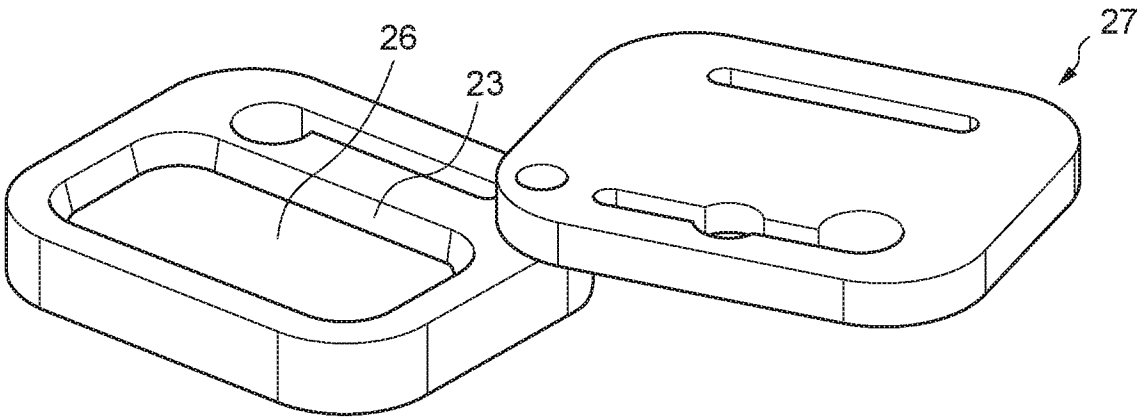
FIG. 4 shows the clamp of FIG. 3 with the block received within the channel.

FIGS. 3 and 4 show an alternative embodiment in which the channel (23) is generally rectangular having parallel inclined sides (24) and ends (25). The clamping block (26) is relatively shallow having a reduced height to permit a thicker sheet, for example a quilted material to be clamped when the retaining member (27) is moved into the closed position.

FIG. 4 shows the clamping block (26) engaged within the lower part of the channel (23) leaving a space above the block (26) so that a quilted sheet material folded around the block (26) will not prevent closure of the retaining member (27).

Figure 5:
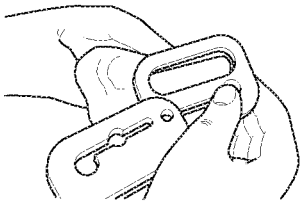
FIG. 5 is a series of views illustrating stages of use of the clamp.
Figure 5:
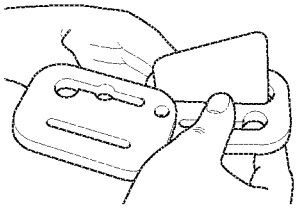
Figure 5:
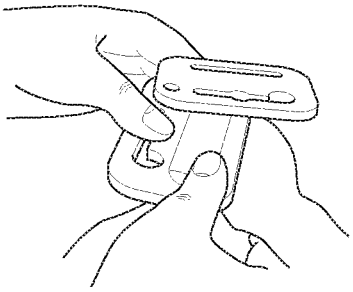
Figure 5:
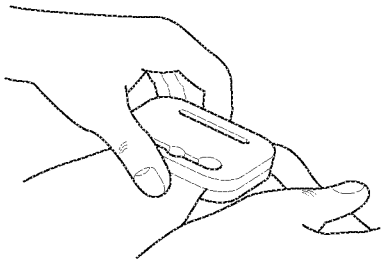
Figure 5:
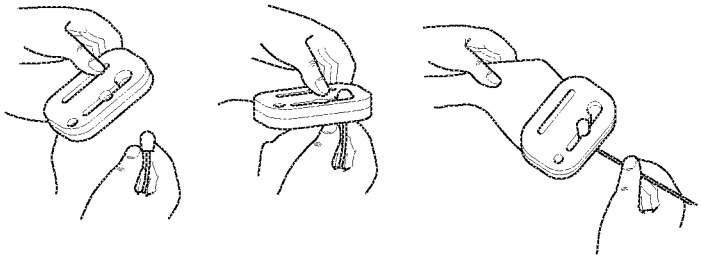
Figure 5:
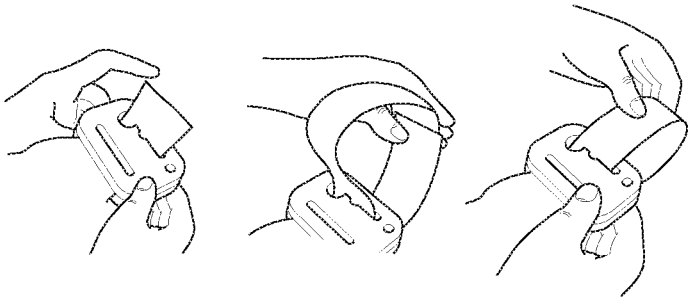

FIG. 5 shows various stages in the use of the clamp.

In FIG. 5A a sheet is wrapped around the lozenge-shaped block. The block is then tilted and inserted into the chamfered channel in the clamp body as shown in FIG. 5B.

In FIG. 5C the block is rotated into the operative position and the sheet and lozenge-shaped block are pulled back through the channel so that the chamfer of the block engages with the chamfer of the clamp body, clamping the sheet between the lozenge-shaped block and the clamp body.

In FIG. 5D the retaining member is closed, retaining the clamp body so that it cannot twist or be removed from the channel.

In FIG. 5E a cord with a cord end is inserted through the bore at the end of the slot. The cord end is the positioned in the rebate/recess located in the middle of the slot. This ensures that the cord end is held centrally in the slot so that a force may be applied perpendicularly of the channel.

In FIG. 5F an alternative arrangement shows a strap fitted through the channel in place of the cord. Other alternatives include webbing or hook and loop.

What is claimed is:

1. A sheet clamp comprising:

a body having first and second sides and an aperture extending between the first and second sides to provide a channel through for a portion of one or more folded sheets may be inserted in use from the first side to the second side;

the channel having opposed side walls, a dimension of the channel between the side walls decreasing from the second side to the first side;

a clamping block having two block sides dimensioned to be received within the channel with the block sides engaging the side walls of the channel when inserted from the second side of the channel;

a retaining member pivotally mounted on the body and moveable between a first position in which the channel is open, permitting the clamping block to be removed from the channel and a second position in which the retaining member covers the channel from the second side preventing removal of the clamping block from the channel.

2. The sheet clamp as claimed in claim 1, wherein a height of the clamping block has a maximum dimension less than a width of the channel.

3. The sheet clamp as claimed in claim 1, wherein a dimension of the clamping block is sufficiently large that the block cannot pass through the channel in an operative orientation.

4. The sheet clamp as claimed in claim 1, wherein the side walls of the channel and the block sides taper uniformly from the second side to the first side.

5. The sheet clamp as claimed in claim 1, wherein the channel and the clamping blocks are elongated in plan view.

6. The sheet clamp as claimed in claim 1, wherein the channel and the clamping block are rectangular or square in plan view.

7. The sheet clamp as claimed claim 1, wherein the block sides complimentary configuration to the side walls of the channel.

8. The sheet clamp as claimed in claim 1, wherein the block sides and the side walls define a gap of constant width dimensioned to receive one or more layers of a sheet material.

9. The sheet clamp as claimed in claim 1, wherein the body includes a second aperture extending between the first and second sides and dimensioned to receive a fixture.

10. The sheet clamp as claimed in claim 9, wherein the second aperture comprises a slot and a larger bore.

11. The sheet clamp as claimed in claim 1, wherein the side walls of the channel and the block sides extend at an angle of 5° to 80° to a channel axis.

12. The sheet clamp as claimed in claim 11, wherein the angle is 5° to 30°, preferably 9° to 11°.

* * * * *